US005271502A

United States Patent [19]

Chang

[11] Patent Number: 5,271,502

[45] Date of Patent: Dec. 21, 1993

[54] FILE HOLDER

[76] Inventor: Chin-Chuan Chang, No. 7-6, Kuo-Chung Rd., Ta Li Hsiang, Taichung Hsien, Taiwan

[21] Appl. No.: 122

[22] Filed: Jan. 4, 1993

[51] Int. Cl.[5] ..... B65D 85/00

[52] U.S. Cl. ..... 206/425; 206/45.13; 206/45.23; 229/72

[58] Field of Search ..... 206/44 B, 45.13, 45.2, 206/45.23, 425, 311; 229/72; 190/900, 901, 902; 150/900

[56] References Cited

U.S. PATENT DOCUMENTS

| | | | |
|---|---|---|---|
| 329,676 | 11/1885 | Reade | 206/425 |
| 821,019 | 5/1906 | Cook, Jr. | 229/72 |
| 856,881 | 6/1907 | Johnson | 229/72 |
| 909,734 | 1/1909 | Zoerb | 229/72 |
| 2,756,515 | 7/1956 | Hoffman | 229/72 |
| 4,262,838 | 4/1981 | Mackenzie | 229/72 |
| 4,415,081 | 11/1983 | Goncalves | 206/311 |
| 4,730,727 | 3/1988 | Petroff | 206/425 |
| 5,064,069 | 11/1991 | Su | 206/425 |
| 5,088,602 | 2/1992 | Heyderman et al. | 206/45.23 |
| 5,193,681 | 3/1993 | Lievsay | 206/425 |

*Primary Examiner*—David T. Fidei

*Attorney, Agent, or Firm*—Parkhurst, Wendel & Rossi

[57] ABSTRACT

A file holder including an outer casing defined by a plurality of panels and a cover serially and hingedly connected to each other. Further, the file holder includes a file assembly having a plurality of compressible envelopes sequentially joined together, wherein a first end of the file assembly is joined to a front panel, and a second end of the file assembly is joined to a movable board. The file holder is cooperable between closed and open positions. In the closed position, the outer casing encloses the file assembly, and is secured via an engaging device. In the open position, two of the panels extend coplanar and away from the front panel, while the cover is rotated upwards and secured to the movable plate via a securing device to provide relatively rigid structure for the file assembly.

1 Claim, 3 Drawing Sheets

FILE HOLDER

BACKGROUND OF THE INVENTION

1. Field of the Invention

The present invention relates to a file holder, and more particularly to a file having a plurality of stretchable and compressible envelopes (i.e., an accordion-like file.

2 Description of the Prior Art

A typical accordion-like file is disclosed in U.S. Pat. No. 5,064,069 to Su, filed Mar. 4, 1991. In this patent, the accordion-like file includes a cover which is useless when the file is unfolded. In addition, the cover has a certain weight and is located on one side of the file such that the file is apt to tilt over.

The present invention has arisen to mitigate and/or obviate the afore-described disadvantages of the conventional accordion-like files.

SUMMARY OF THE INVENTION

The primary objective of the present invention is to provide an accordion-like file which can be stably supported in place and is not apt to tilt over when unfolded.

In accordance with one aspect of the invention, there is provided an accordion-like file comprising a panel, a bottom, a plate, an extension and a cover coupled together in series and foldable relative to one another, a first engaging means provided on the panel, a second engaging means provided on the cover and engaged with the first engaging means when the cover is engaged with the panel, a board, a plurality of envelopes including a first end secured to the panel and including a second end secured to the board, the board being movable toward and away from the panel, and a third engaging means provided on the board and engageable with the second engaging means of the cover when the board moves toward the cover, whereby, the accordion-like file is stably supported in place.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
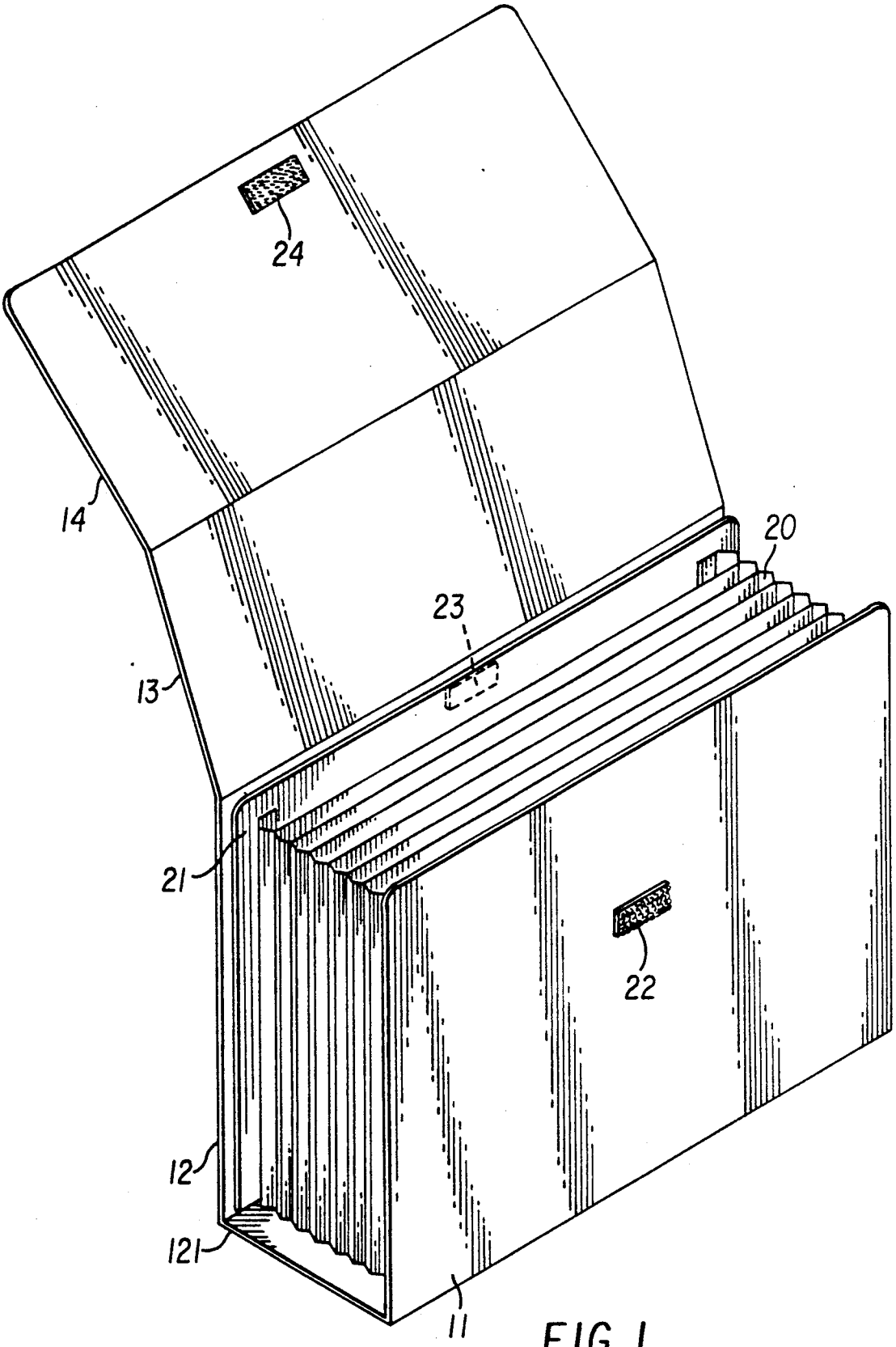
FIG. 1 is a perspective view of an accordion-like file in accordance with the present invention.
Figure 2:
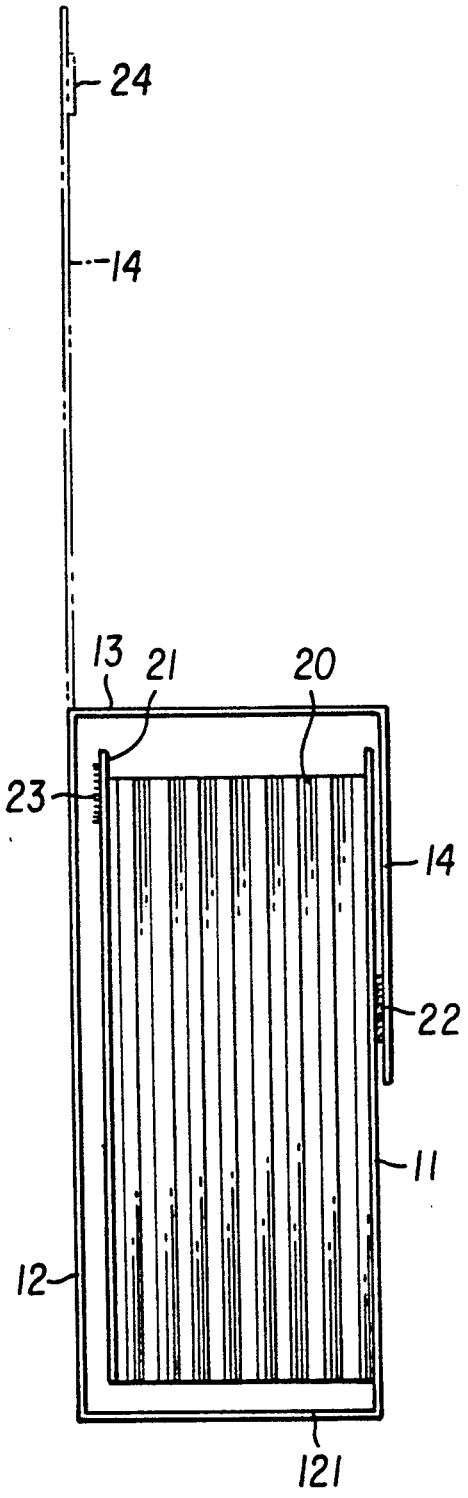
FIG. 2 is a side view of the accordion-like file.

Referring to the drawings, and initially to FIGS. 1 and 2, an accordion-like file in accordance with the present invention comprises a panel 11, a bottom 121, a plate 12, an extension 13 and a cover 14 coupled together in series and foldable relative to one another. Engaging surfaces 22, 24 (e.g., a VELCRO strip are provided on the panel 11 and the cover 14 respectively. The engaging surfaces 22, 24 are engaged with each other when the accordion-like file is folded as shown in FIG. 2. A plurality of envelopes 20 include one end secured to the panel 11 and the other end secured to a board 21 which is freely movable either towards or away from the panel 11 because the envelopes 20 are stretchable and compressible. The bottom surface of the envelopes 20 is not secured to the bottom 121 or the plate 12, and an engaging surface 23 is provided on the board 21. Board 21 is movable with respect to plate 21.

Figure 3:
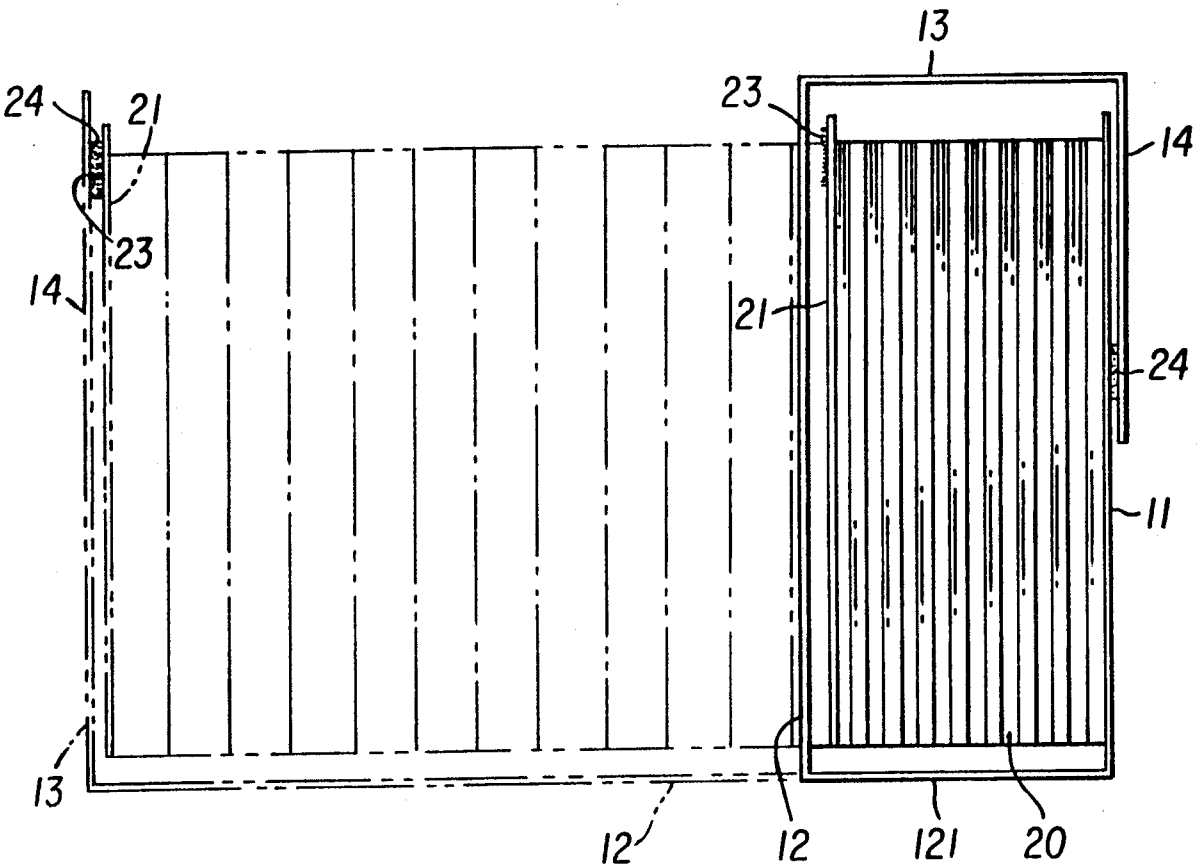
FIG. 3 is a side schematic view illustrating the operations of the accordion-like file.

In operation, as shown in FIG. 3, when the accordion-like file is unfolded, the bottom 121 and the plate 12 are disposed horizontally, while extension 13 and the cover 14 are arranged to be parallel with the panel 11. The envelopes 20 are stretched until the engaging surface 23 of the board 21 is engaged with the engaging surface 24 of the cover 14. It is to be noted that the cover 14 forms one side portion of the accordion-like file such that the accordion-like file can be stably supported in place and is not apt to tilt over.

Accordingly, the accordion-like file in accordance with the present invention can be stably supported in place when unfolded.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A file holder comprising:

an outer casing comprising a front panel, a bottom panel, a rear panel, an extension panel and a cover serially connected to each other, wherein at least said bottom panel and said rear panel, said rear panel and said extension panel, and said extension panel and said cover, respectively, are hingedly connected to each other at joining edges thereof, said bottom panel extending away from said front panel along a first direction, each of said panels comprising interior and exterior opposite surfaces;

a file assembly comprising a plurality of envelopes sequentially joined together, a first end of the file assembly being fixedly secured to the interior surface of the front panel, said file assembly extending along said first direction away from said front panel, a second end of the file assembly being secured to a moveable board, said moveable board extending generally parallel to said front panel and being movable along said first direction and a second direction opposite said first direction so as to expand and contract, respectively, the file assembly; and first engaging means provided on the interior surface of said cover, second engaging means provided on the exterior surface of said front panel and third engaging means provided on the exterior surface of said movable board, wherein said file holder is cooperable between closed and open positions, said closed position being defined by said outer casing being folded to define an inner area in which said file assembly is housed, the rear panel extending generally parallel to the front panel, the extension panel extending substantially parallel to the bottom panel, and said cover extending generally parallel to said front panel such that said first and second engaging means are secured together, said open position being defined by the bottom panel and the rear panel being substantially coplanar and extending along said first direction, said extension panel and said cover extending substantially coplanar and perpendicular to the rear panel and generally parallel to the front panel such that said first and third engaging means are secured together.

* * * * *